US009414645B2

(12) United States Patent
Krueger

(10) Patent No.: US 9,414,645 B2
(45) Date of Patent: Aug. 16, 2016

(54) SHOE, IN PARTICULAR SPORTS SHOE

(75) Inventor: Thomas Krueger, Aurachtal (DE)

(73) Assignee: PUMA SE, Herzogenaurach (DE)

( * ) Notice: Subject to any disclaimer, the term of this patent is extended or adjusted under 35 U.S.C. 154(b) by 4 days.

(21) Appl. No.: 14/376,275

(22) PCT Filed: Feb. 4, 2012

(86) PCT No.: PCT/EP2012/000513

§ 371 (c)(1),
(2), (4) Date: Aug. 1, 2014

(87) PCT Pub. No.: WO2013/113339

PCT Pub. Date: Aug. 8, 2013

(65) Prior Publication Data

US 2015/0013193 A1 Jan. 15, 2015

(51) Int. Cl.

| | |
|---|---|
| ***A43C 11/00*** | (2006.01) |
| ***A43C 1/06*** | (2006.01) |
| ***A43C 7/06*** | (2006.01) |
| ***A43C 1/00*** | (2006.01) |
| ***A43B 23/02*** | (2006.01) |
| ***A43C 1/04*** | (2006.01) |
| ***A43B 5/00*** | (2006.01) |

(52) U.S. Cl.

CPC ... *A43C 1/06* (2013.01); *A43B 5/00* (2013.01); *A43B 23/0265* (2013.01); *A43C 1/00* (2013.01); *A43C 1/006* (2013.01); *A43C 1/04* (2013.01); *A43C 7/06* (2013.01)

(58) Field of Classification Search

CPC ..... A43B 5/00; A43B 23/025; A43B 23/026; A43B 23/045; A43B 23/0245; A43B 23/0265; A43B 23/0235; A43C 1/00; A43C 1/02; A43C 1/04; A43C 1/06; A43C 1/003; A43C 1/006; A43C 3/04; A43C 5/00; A43C 7/00; A43C 7/06; A43C 7/08; A43C 11/00; A43C 11/006; A43C 11/004; A43C 11/16; A43C 11/22

USPC ..... 36/45, 50.1, 58.5, 58.6, 83, 114

See application file for complete search history.

(56) References Cited

U.S. PATENT DOCUMENTS 5,291,671 A * 3/1994 Caberlotto et al. ..... 36/88
5,371,957 A * 12/1994 Gaudio ..... 36/50.1

(Continued)

FOREIGN PATENT DOCUMENTS

EP 0937418 A2 8/1999
FR 2902982 A1 * 1/2008 ..... A43C 1/00

(Continued)

*Primary Examiner* — Alissa L Hoey
*Assistant Examiner* — Jameson Collier
(74) *Attorney, Agent, or Firm* — Lucas & Mercanti, LLP

(57) ABSTRACT

The invention relates to a shoe, in particular to a sports shoe, which has a shoe upper part and a sole which is connected to the shoe upper part, wherein the shoe upper part having two tensioning sections which are arranged adjacently in a tensioning region and are separated by a gap, wherein a fastening system is arranged by which the shoe can be fastened to the foot of the wearer of the shoe by a fastening lace as a result of the adjacently arranged tensioning sections being drawn towards one another. In order to improve the tension of the shoe on the foot of the wearer, the fastening system includes, in addition to the fastening lace, at least one tie element which has two ends, and wherein a loop of the at least one tie element formed in the region of the tensioning section being enlaced by the fastening lace.

14 Claims, 3 Drawing Sheets

(56) References Cited

U.S. PATENT DOCUMENTS

Figure 1:
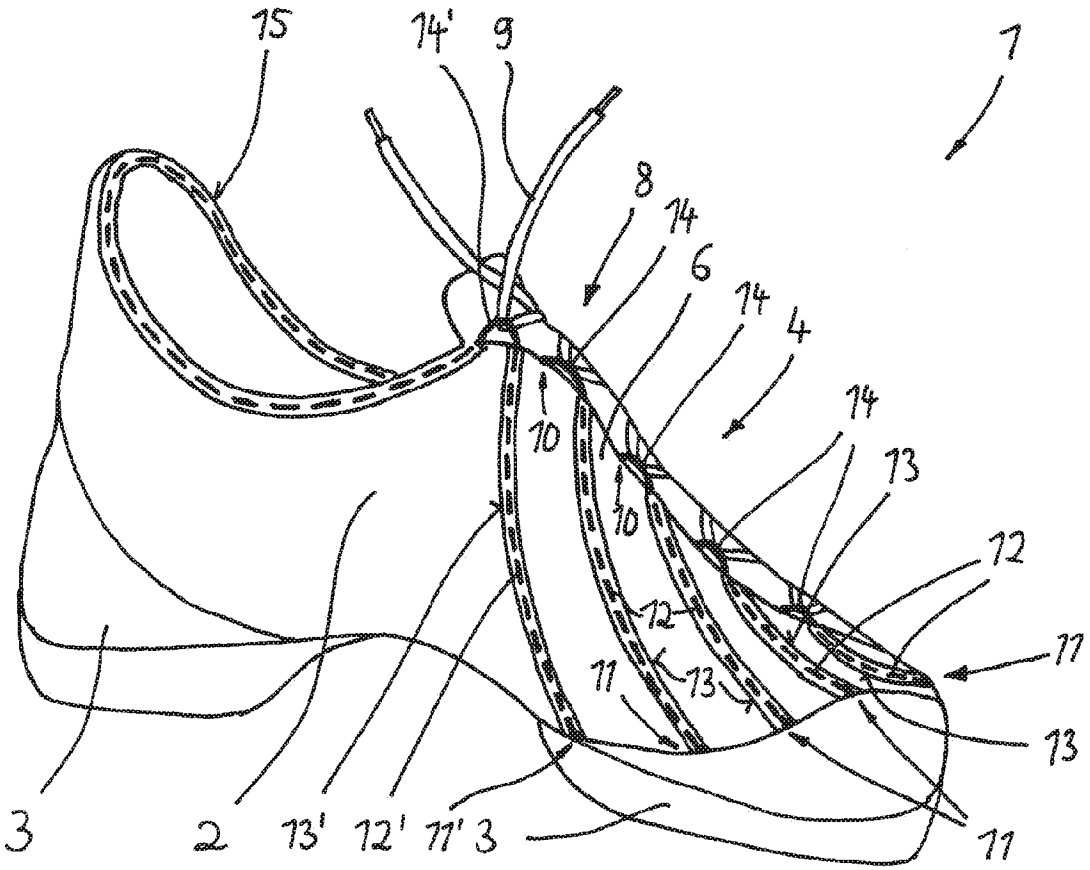

| | | | | |
|---|---|---|---|---|
| 6,029,376 | A * | 2/2000 | Cass | 36/50.1 |
| 6,032,387 | A * | 3/2000 | Johnson | A43C 1/06 36/118.1 |
| 6,052,921 | A * | 4/2000 | Oreck | 36/50.1 |
| 6,128,835 | A * | 10/2000 | Ritter et al. | 36/45 |
| 7,370,440 | B1 * | 5/2008 | Cole, III | A43B 5/003 36/50.1 |
| 8,844,167 | B2 * | 9/2014 | Greene | 36/45 |
| 8,881,430 | B2 * | 11/2014 | Seamarks et al. | 36/45 |
| 2002/0148142 | A1 * | 10/2002 | Oorei et al. | 36/129 |
| 2004/0181972 | A1 | 9/2004 | Csorba | |
| 2006/0005429 | A1 * | 1/2006 | Min | 36/50.1 |
| 2006/0059715 | A1 * | 3/2006 | Aveni | 36/45 |
| 2006/0283042 | A1 * | 12/2006 | Greene et al. | 36/3 A |
| 2007/0068040 | A1 * | 3/2007 | Farys | 36/50.1 |
| 2008/0110048 | A1 * | 5/2008 | Dua et al. | 36/45 |
| 2008/0110049 | A1 * | 5/2008 | Sokolowski et al. | 36/50.1 |
| 2009/0199435 | A1 * | 8/2009 | Robinson, Jr. | A43C 1/06 36/108 |
| 2010/0154256 | A1 | 6/2010 | Dua | |
| 2012/0174437 | A1 * | 7/2012 | Heard | A43C 1/04 36/50.1 |
| 2012/0198727 | A1 * | 8/2012 | Long | A43B 23/0235 36/25 R |
| 2012/0246973 | A1 * | 10/2012 | Dua | 36/83 |
| 2013/0219750 | A1 * | 8/2013 | Dojan et al. | 36/87 |
| 2014/0130372 | A1 * | 5/2014 | Aveni et al. | 36/83 |
| 2014/0196311 | A1 * | 7/2014 | Follet et al. | 36/45 |
| 2014/0223779 | A1 * | 8/2014 | Elder et al. | 36/103 |
| 2015/0013186 | A1 * | 1/2015 | Greene | A43B 23/025 36/83 |

FOREIGN PATENT DOCUMENTS

| | | |
|---|---|---|
| JP | S4-3797 Y | 4/1929 |
| JP | 2013517843 | 5/2013 |
| WO | 2012/106502 A1 | 8/2012 |

* cited by examiner

SHOE, IN PARTICULAR SPORTS SHOE

CROSS-REFERENCE TO RELATED APPLICATIONS

This application is a 371 of PCT/EP2012/000513 filed Feb. 4, 2012, the priority of which is hereby claimed and incorporated by reference herein.

The invention relates to a shoe, in particular to a sports shoe, which has a shoe upper part and a sole which is connected to the shoe upper part, wherein the shoe upper part having two tensioning sections which are arranged adjacently in a tensioning region and are separated by a gap, wherein a fastening system is arranged by which the shoe can be fastened to the foot of the wearer of the shoe by means of a fastening lace as a result of the adjacently arranged tensioning sections being drawn towards one another.

Such a shoe is well-known and disclosed for example in EP 0 937 418 B1, here for a ski boot. The tensioning of the shoe at the foot of the wearer takes place by tensioning of a lace, which tightens the two strip-shaped tensioning sections and thus fixes the shoe at the foot of the wearer.

Especially at sport applications, for example at soccer, it is thereby aimed for to transmit the tension to the foot of the wearer as equally as possible—which is caused by the tensioned lace. Pre-known sport shoes are occasionally insofar detrimental because the tension distributes only on parts of the area of the shoe upper part and thus occurs that in total the distribution of the tensioning threes is not equal.

Thereby it is furthermore not possible at known fastening systems to tension specific regions of the foot well-directed. Specifically at soccer it is again detrimental that the forefoot cannot be tensioned well-directed.

It is the object of the invention to further develop a shoe of the generic kind so that an improved tensioning of the shoe on the foot of the wearer is obtained. Especially the tension should be distributed more equally onto the foot of the wearer which tension is created during the fastening of the lace. By doing so also the hold of the shoe at the foot of the user should be improved. Furthermore, it is aimed for that also the forefoot as such can be well-directed tensioned.

The solution of this object by the invention is characterized in that the fastening system comprises, in addition to the fastening lace, at least one tie element which has at least two ends, wherein one end of the tie element being secured in the region of one of the two tensioning sections, wherein the tie element extending into the region of the sole, wherein the tie element running from the tensioning section till the sole at least in some sections in at least one guide in which the tie element is at least partially displaceably arranged in the direction of the longitudinal axial of the tie element and wherein a loop of the tie element formed in the region of the tensioning section being enlaced by the fastening lace.

The other end of the tie element is preferably secured in the region of the sole, i.e. especially in the transition zone between the shoe upper part and sole, at the shoe upper part and/or at the sole.

The guide runs preferably continuously from the tensioning section to the sole. The guide can run bow-shaped from the tensioning section to the sole.

Furthermore, at least one guide can run at least in some sections in the direction of the longitudinal axis of the shoe.

Preferably, between two and eight guides are arranged, in which respective tie elements run.

A preferred embodiment of the proposed shoe provides a further tie element, which runs in a further guide, wherein the further tie element—coming from the region of the sole—is guided in a circular guide around the heel region respectively of the rear side of the foot of the wearer of the shoe. The circular guide can thereby be arranged in the upper edge region of the shoe upper part. The further tie element can—coming from the circular guide—run along the other tensioning section and can be connected at least in some sections with the same. The further tie element can thereby be connected with the other tensioning section in the region of the other tensioning section in such a manner that a relative displacement is possible between the further tie element and the tensioning section in the direction of the longitudinal axis of the further tie element. Preferably, it is thereby provided that the further tie element is arranged in a hose-shaped or tube-shaped guide which is interrupted in sections which is attached at the other tensioning section. The further tie element can be enlaced by the fastening lace in the region of the other tensioning section. The further tie element can furthermore—coming from the other tensioning section—be guided in a supplementary guide till the region of the sole.

The mentioned guide, the further guide, the circular guide and/or the supplementary guide can have a hose-shaped or tube-shaped design.

The tie element respectively the further tie element consist preferably of a wire made of high tensile strength material, especially aramid (trademark inter alia KEVLAR).

The proposed shoe is preferably a soccer shoe.

The different tensioning elements in their respective guides are preferably distributed along a noteworthy part of the surface of the shoe upper part in the forefoot and midfoot region and thereby especially guided bow-shaped. The hold of the shoe at the foot of the wearer can thereby be optimized. Simultaneously, tension concentrations can be reduced, i.e. so-called irritation points.

The tie elements can be guided in such a manner that they do not run via the metatarsal heads of the metatarsal bone, whereby a natural and convenient tension of the shoe at the foot of the wearer can be ensured.

A possible but due to the more elaborate design not preferred embodiment of the invention provides that at least some of the tie element are not fixed with their respective end in the region of the sole but run around the shoe underneath the sole.

Accordingly, the invention provides a fastening system respectively tensioning system for a shoe, especially for a soccer shoe, at which tensioning threads respectively tensioning wires—preferably made of aramid—are arranged in tube-shaped guides. The tensioning threads respectively tensioning wires are preferably fixed in the sole region and are guided along the tube-shaped guide upwards in the tensioning section. Here, an end of at least one tensioning thread respectively tensioning wire is fixed at the upper part of the tensioning region and specifically in one of the tensioning sections of the shoe (preferably sewed). The lace meshes with a lug of the tensioning thread respectively tensioning wire which is formed in the upper region and pulls together preferably several of such lugs during lacing—which lugs result from the respective tensioning threads respectively tensioning wires.

The proposed lacing system can be beneficially employed also at other sports than soccer. Thereby it can then be provided that the run of the single hose-shaped respectively tube-shaped guides is adjusted to the respective concrete and specific purpose. For example, in the case of a running shoe the special lacing of the forefoot is not desired.

A special embodiment of the invention proposes that the two shoes for the right and for the left foot are not designed mirror-symmetrically but asymmetrical. By doing so special demands of some sports can be taken into account. For the use of the proposed shoe for golfing a lateral support function by the tie elements is desirable to act against the occurring forces during the rotation of the foot at the golf swing. In this case the right and the left shoe can be designed differently with respect to the run of the tie elements, i.e. of the hose-shaped respectively tube-shaped guides, to obtain the mentioned effect.

Classical fastening systems which use laces are basing on the fact that the areas are fixed punctual (thus at a single anchor point) at the shoe upper part which areas are pulled together by the lace. In the present case the tie elements are preferably fixed at two locations of the shoe upper part respectively near or at the sole so that the desired effect of the equilibration of the tension is obtained.

Insofar two anchor points are given for the tie element, namely one in the upper part of the shoe upper part in the tensioning section and one in the region near the sole. Between this two anchor points a free run of the tie element in its guide is possible.

Hence, an improved tensioning of the shoe at the foot is obtained. A classical lacing occurs with the tensioning threads respectively tensioning wires which are fixed in the upper section of the shoe upper part, i.e. in the instep section; the tensioning threads respectively tensioning wires which run preferably in bow-shaped guides along the shoe upper part span plane along the extension of the shoe upper part to the sole region which leads to a more equal distribution of the tension.

Insofar a quasi dynamic fastening system is proposed which results in an equilibration of the tensioning forces onto the surface of the foot by the provided guides for the tensioning thread respectively tensioning wire. The thereby obtained improved hold of the shoe at the foot of the wearer is specifically useful for soccer.

The single tensioning threads respectively tensioning wires can be pulled and tensioned independently from another, what results in an equal distribution of the forces and in a reliable lacing from the sole upwards.

The mentioned tie elements are fixed—as explained—in the region between the shoe upper part and the sole. But this is also to be understood in that way that the fixation point (anchor point) is arranged not exactly at the transition between the shoe upper part and the sole; it is also possible that the anchor point is arranged a bit above the sole at the shoe upper part; at the other hand the anchor point can also be arranged lower than the transition point from the shoe upper part to the sole.

Figure 2:
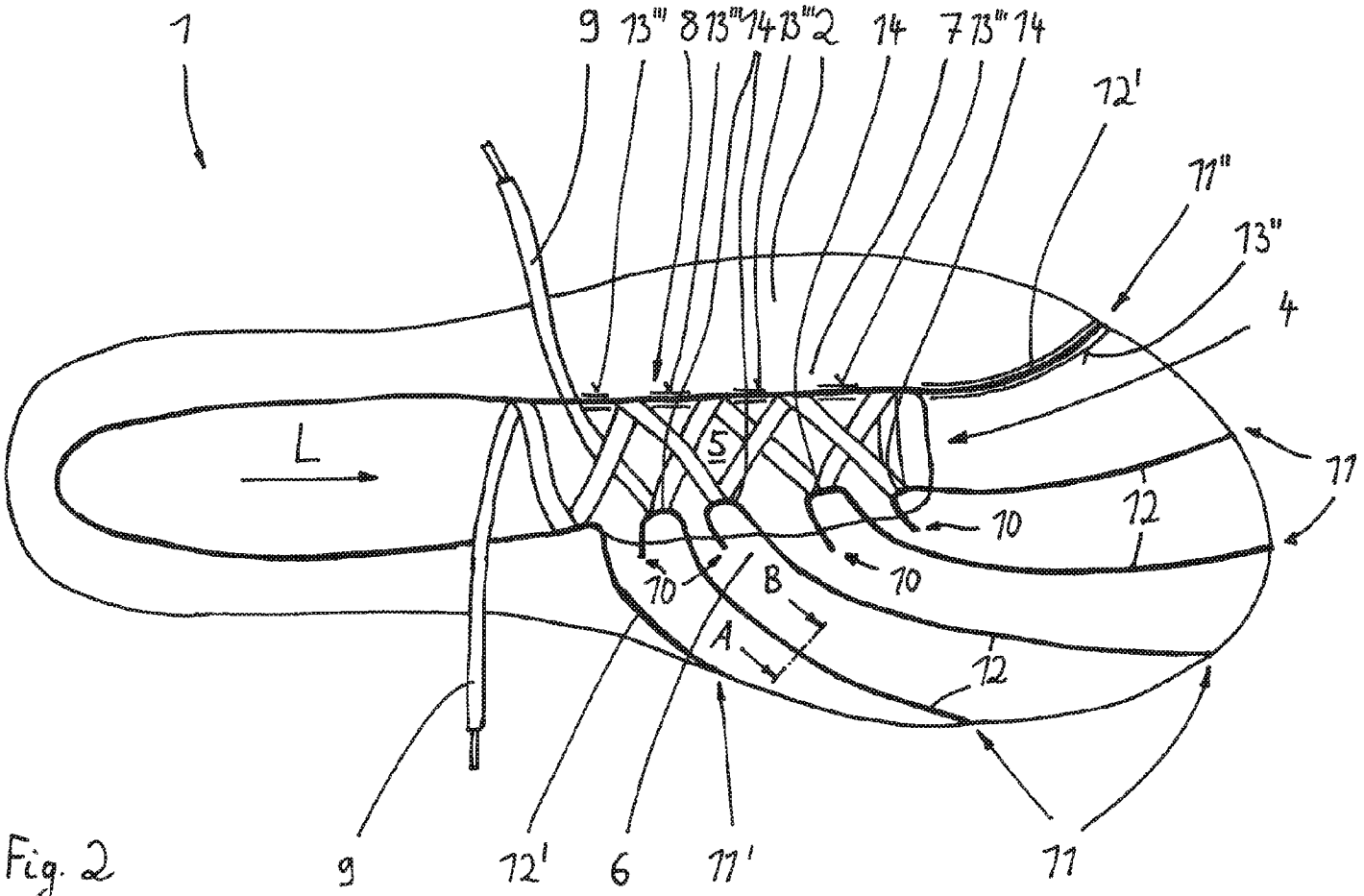
Figure 3:
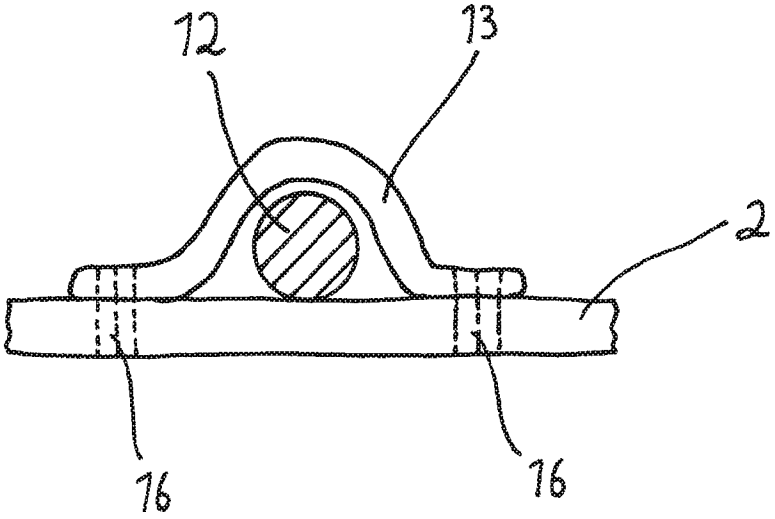

In the drawing an embodiment of the invention is depicted. It shows:

FIG. 1 in perspective view a sports shoe which is provided with the fastening system according to the invention, FIG. 2 in a top plan view the sport shoe according to FIG. 1, wherein guides for tie elements are to a large extend not depicted so that the run of the tie elements can be seen in a better way, and FIG. 3 schematically the section A-B according to FIG. 2 through a part of the shoe upper part.

In FIGS. 1 and 2 a sports shoe 1 is shown which comprises in know manner a shoe upper part 2 and a sole 3 which is fixed at the bottom of the shoe upper part 2. For the tensioning of the shoe 1 at the foot of the wearer a tension region 4 is arranged which is formed by two lamellar and if applicable reinforced tensioning sections 6, 7, which is known as such, which tensioning sections are running parallel to another—being separated by a gap 5 (see FIG. 2). A fastening system 8 which comprises a fastening lace 9 pulls together the tensioning sections 6, 7 during lacing of the shoe 1, whereby the shoe is fixed at the foot of the wearer.

The fastening system 8 of the present shoe comprises a plurality of tie elements 12, 12' which are guided in respective guides 13, 13', 13" and which are arranged displaceably along the longitudinal axis of the tie elements in the guides. Presently, wires respectively threads made from aramid are used as tie elements; this material is inter alia known by the trademark KEVLAR.

As can be seen from the synopsis of FIGS. 1 and 2, presently four tie elements 12 are arranged, each of them having two ends 10 and 11. The tie elements 12 are fixed, e.g. sewed, at the tensioning section 6 with the upper end 10. However, the tie elements 12 are fixed (e.g. sewed) with their bottom end 11 in the region of the sole 3, i.e. in the transition area between the shoe upper part 2 and the sole 3. The tie element 12 is arranged in a guide 13 between the so formed two anchor points 10, 11 along the essential run of the same.

In FIG. 1 guides 13 are depicted, in FIG. 2 they are not shown except of a supplementary guide 13"—so that the run of the tie element 12 can be seen in a better way; the tie element 12 which are arranged in the guides 13 and which are thus not visible are shown in FIG. 1 with dashed lines.

In the region of the tensioning section 6 a loop 14 is formed for the four tie element 12 which are enlaced by the fastening lace 9. When the fastening lace 9 is pulled the four loops 14 are pulled to the tensioning section 7 accordingly. The tension force, which is brought onto the tie element 12 by that, is distributed equally onto the surface of the foot of the wearer via the run of the tie elements 12 in the guide 13.

Furthermore, a further tie element 12" is arranged which is however guided in a different way. It is again fixed with one of its ends 11 the region of the sole and runs in a further guide 13' from here upwards in the region of the tensioning section 6. Also, the further tie element 12' is enlaced here by the fastening lace 9 at a loop 14'.

However, the further tie element 12' is guided from here into a tube-shaped circular guide 15 which runs around the heel respectively the rear side of the foot of the wearer. After passing of the circular guide 15 the further tie element 12' is guided forward along the tensioning section 7 in the longitudinal direction L of the shoe. Here, it is connected with the tensioning section 7 in sections; in FIG. 2 four guide parts 13'") are denoted which are connected with the tensioning section 7 and which form a holder for the further tie element 12'.

Between the guide parts 13'" the further tie element 12' is free so that it can be enlaced by the fastening lace 9.

In the further run of the further tie element 12' it is guided into a supplementary guide 13" (see FIG. 2). At the end 11" the further tie element 12' is again fixed in the region of the sole 3 of the shoe 1.

A possible embodiment of the guides—here shown for a guide 13—is shown in FIG. 3 where the section A-B according FIG. 2 is depicted. The guide 13 is formed (semi)tube-shaped respectively (semi)hose-shaped and by means of seams 16 fixed at the shoe upper part 2.

LIST OF REFERENCES

1 Shoe
2 Shoe upper part
3 Sole
4 Tensioning region
5 Gap
6 Tensioning section
7 Tensioning section

8 Fastening system
9 Fastening lace
10 End of the tie element
11 End of the tie element
11', 11" Ends of further tie element
12 Tie element
12' Further tie element
13 Guide
13' Further guide
13" Supplementary guide
13'" Guide part
14 Loop
14' Loop
15 Circular guide
16 Seam
L Longitudinal axis of the shoe/longitudinal direction of the shoe

The invention claimed is:

1. Shoe, comprising:

a shoe upper part and a sole which is connected to the shoe upper part, the shoe upper part has two tensioning sections arranged adjacently in a tensioning region and separated by a gap, a fastening system comprising a fastening lace and at least one tie element, the fastening system arranged by which the shoe can be fastened to the foot of the wearer of the shoe by the fastening lace as a result of the adjacently arranged tensioning sections being drawn towards one another, the at least one tie element has two ends, a first end of the two ends of the at least one tie element is directly secured in the region of a first of the two tensioning sections, the at least one tie element extending into the region of the sole and a second end of the two ends of the at least one tie element is directly secured in the region of the sole, the at least one tie element running from the first of the two tensioning sections to the sole, at least one guide on the shoe upper part in which the at least one tie element is at least partially displaceably arranged in a direction of a longitudinal axis of the at least one tie element, and an open loop is formed in the at least one tie element, a first end of the open loop is the first end of the at least one tie element, the first end of the open loop is spaced apart from a top end of the respective guide, and the loop is enlaced by the fastening lace.

2. Shoe according to claim 1, wherein the second end of the at least one tie element is directly secured in the region of the sole at the shoe upper part or at the sole.

3. Shoe according to claim 1, wherein the at least one guide runs continuously from the first of the two tensioning sections to the sole.

4. Shoe according to claim 1, wherein the at least one guide runs bow-shaped from the first of the two tensioning sections to the sole.

5. Shoe according to claim 1, wherein the at least one guide runs at least in some sections in the direction of a longitudinal axis of the shoe.

6. Shoe according to claim 1, wherein a second of the at least one tie element is arranged in a second of the at least one guide, the second of the at least one tie element coming from the region of the sole and guided in a circular guide around a heel region of the shoe upper part of the shoe.

7. Shoe according to claim 6, wherein the circular guide is arranged in an upper edge region of the shoe upper part.

8. Shoe according to claim 6, wherein the second of the at least one tie element, coming from the circular guide, runs from the first of the two tensioning sections to the second of the two tensioning sections and is connected at least in some sections with the second of the two tensioning sections.

9. Shoe according to claim 8, wherein the second of the at least one tie element is connected with the second of the two tensioning sections in the region of the second of the two tensioning sections in such a manner that a relative displacement is possible between the second of the at least one tie element and the first of the two tensioning sections in the direction of a longitudinal axis of the second of the at least one tie element, the second of the at least one tie element is arranged in a tube-shaped guide which is interrupted in sections and is attached at the second of the two tensioning sections.

10. Shoe according to claim 8, wherein the second of the at least one tie element is enlaced by the fastening lace in the region of the second of the two tensioning sections.

11. Shoe according to claim 6, wherein the second of the at least one tie element, coming from the second of the two tensioning sections, is guided in a supplementary guide to the region of the sole.

12. Shoe according to claim 1, wherein the at least one guide has a tube-shaped design.

13. Shoe according claim 1, wherein the at least one tie element consists of a wire made of high tensile strength material.

14. Shoe according to claim 1, wherein the shoe is a soccer shoe.

* * * * *